United States Patent [19]

Eastlund et al.

[11] Patent Number: 4,716,960

[45] Date of Patent: Jan. 5, 1988

[54] METHOD AND SYSTEM FOR INTRODUCING ELECTRIC CURRENT INTO A WELL

[75] Inventors: Bernard J. Eastlund, Spring; Kenneth J. Schmitt, The Woodlands; Ronald M. Bass; John M. Harrison, both of Houston, all of Tex.

[73] Assignee: Production Technologies International, Inc., Houston, Tex.

[21] Appl. No.: 884,963

[22] Filed: Jul. 14, 1986

[51] Int. Cl.[4] ..... E21B 36/00; H01R 4/64

[52] U.S. Cl. ..... 166/60; 166/62; 166/65.1; 219/277; 439/193

[58] Field of Search ..... 166/57, 60, 65.1, 62, 166/66.5, 302, 248; 219/277, 278, 415, 419, 471; 405/131; 285/41, 47, 48; 174/21 R, 64, 65 R, 85; 339/13, 15, 16 R

[56] References Cited

U.S. PATENT DOCUMENTS

| | | | |
|---|---|---|---|
| 2,096,279 | 10/1937 | Karcher | 339/16 R |
| 2,217,857 | 10/1940 | Byck | 166/65.1 |
| 2,660,249 | 11/1953 | Jakosky | 166/62 |
| 2,714,930 | 8/1955 | Carpenter | 166/60 |
| 2,757,738 | 8/1956 | Ritchey | 166/248 |
| 2,982,354 | 5/1961 | Green | 166/60 |
| 3,507,330 | 4/1970 | Gill | 166/248 |
| 3,547,193 | 12/1970 | Gill | 166/248 |
| 3,605,888 | 9/1971 | Crowson et al. | 166/248 |
| 3,614,986 | 10/1971 | Gill | 166/302 |
| 3,620,300 | 11/1971 | Crowson | 166/248 |
| 3,642,066 | 2/1972 | Gill | 166/248 |
| 3,859,503 | 1/1975 | Palone | 166/60 |
| 3,958,636 | 5/1976 | Perkins | 166/248 |
| 4,010,799 | 3/1977 | Kern et al. | 166/248 |
| 4,140,179 | 2/1979 | Kasevich et al. | 166/248 |
| 4,401,162 | 8/1983 | Osborne | 166/248 |

OTHER PUBLICATIONS

Newbold and Perkins, "Wellbore Transmission of Electrical Power", JCPT, Jul.-Sep. 1978, pp. 39-52.

Afkhampour, K. H., "A Novel Approach to Solving Downhole Fluid Flow Problems Using Electrical Heating Systems", IEEE paper No. PCIC-85-35, 1985.

Wash, R., "Electromagnetic Energy Helps Recovery", Gulf Coast Oil World, Jun. 1986, pp. 18-19.

*Primary Examiner*—Stephen J. Novosad
*Assistant Examiner*—Bruce M. Kisliuk
*Attorney, Agent, or Firm*—Vinson & Elkins

[57] ABSTRACT

An invention for supplying power to a well. In one embodiment power heats a tubing from adjacent the surface to a selected level to prevent the formation of solids. The tubing is heated by passing an electric current therethrough. In one form the tubing is insulated from the wellhead and the casing down to a selected level where an electrical connection is made between the tubing and casing. Current is applied to the tubing at a point below an insulating tubing collar. In another form an insulated conduit is run into the well to a selected depth and connected to the tubing. Electrical power is connected to the tubing and to the insulated conduit.

In another form a sucker rod is electrically insulated from the tubing down to a selected depth. The sucker rod includes a non-conducting section such as a fiberglas sucker rod. A conduit is run through the fiberglas rod and connected to the steel sucker rod therebelow.

Also disclosed is a system for preventing formation of solids in a petroleum well by suspending a loop of wire in a well and passing a controlled amount of power along said loop of wire to heat the wire in which the loop of wire has sections of different resistance to apply different amounts of heat at different depths of the well. Further, there is disclosed an electromagnet for use as a contact between a wire and a well tubing and/or as an anchor.

12 Claims, 17 Drawing Figures

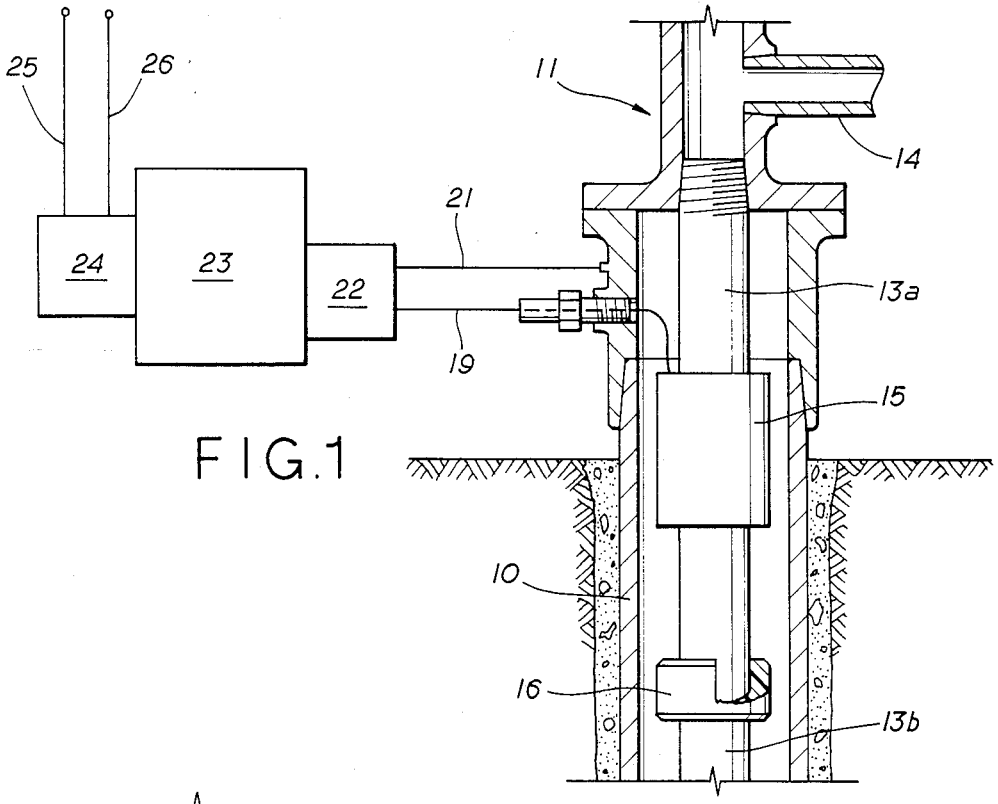
FIG.1
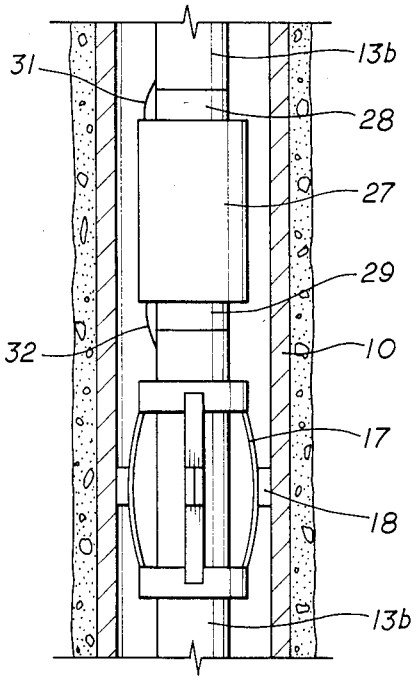
FIG.2
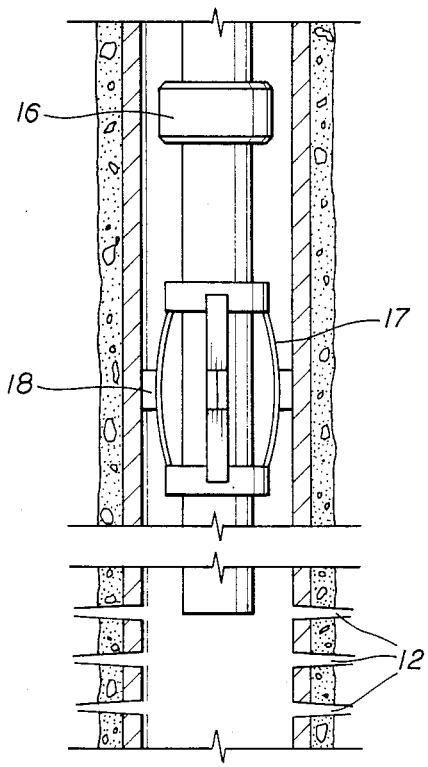

METHOD AND SYSTEM FOR INTRODUCING ELECTRIC CURRENT INTO A WELL

This invention relates to a method and system for introducing electric power into a petroleum well. Power may be used to heat the tubing or drive a load such as a pump.

Formation of solids such as hydrates or paraffin within the tubing of a petroleum well is a serious problem in many oil fields. Solids such as paraffin have conventionally been removed by various procedures such as scraping the tubing, providing scrapers on sucker rods, hot oil treatment, etc.

Electric power has been used in wells to heat formations, and heating of the tubing to prevent formation of paraffins is known.

In one aspect of this invention, a part of the conventional well equipment such as tubing or casing is utilized to provide a part of the power supply system with the entire wellhead, that is, all exposed portions of the well above ground, being grounded, thus preventing possible injury to personnel or damage to equipment at the surface.

In one aspect power is connected to the wellhead and to an insulated conductor extending down into the well. At a selected depth the insulated conductor is electrically connected to the pipe within the well. The insulated conductor may be provided by a tubing insulated from the casing and from the wellhead, by a sucker rod insulated from the tubing and from the wellhead, or by an insulated conduit extending into the well and connected to the tubing. In another form power may be delivered to a downhole device such as a motor without the use of conventional power conduits by insulating the tubing from the wellhead and from the casing down to the motor and passing the current through the motor to the casing.

In still another form, a coaxial cable having sections of different resistance is used to heat a well tubing and fluid therein.

In installations utilizing a cable suspended in a well, an electromagnet may be used to anchor the lower end of the cable to the tubing and/or to provide an electrical connection with the tubing.

An object of this invention is to electrically heat the tubing of a petroleum well by passing current through the tubing to prevent formation of solids such as paraffins.

Another object of this invention is to electrically heat the tubing of a well by passing current through the tubing to prevent formation of solids in which all of the wellhead equipment above ground is grounded to prevent accidents.

Another object is to provide a method and system for heating a tubing to prevent formation of solids therein in which the tubing and casing are used as electrical conduits and the wellhead is grounded.

Another object is to provide a method and system for heating the tubing of a petroleum well in which the sucker rod of a pump in the well and the tubing are used as electrical conduits and the wellhead is grounded.

Another object is to provide a method and system for heating the tubing of a petroleum well in which the tubing is utilized as one conductor of electricity and the wellhead is grounded.

Another object is to utilize the tubing and casing of a petroleum well as conduits to deliver power to equipment in the well in which the wellhead is grounded.

Another object is to provide a tubing collar to insulate between two sections of well tubing and to connect a power conduit to the collar.

Another object is to heat a tubing and its contents with a coaxial cable suspended in a tubing in which the cable has sections of different resistance to provide different levels of heat.

Another object of this invention is to electrically heat the tubing of a petroleum well to prevent formation of solids such as paraffins with a loop of wire having different resistance at different elevations to generate different amounts of heat at different elevations in the well.

Another object is to heat the tubing of a well as in the above object in which a coaxial cable having an outer braid of steel wire for tensional strength is used and along a selected section of the cable a low resistance conductor such as a copper wire, preferably a braid of copper wire, engages the braid of steel wire to lower the total resistance of the selected section of the cable.

Another object is to provide an electromagnet on the lower end of a cable suspended in a well tubing to anchor the lower end of the cable and/or to provide an electrical connection between the cable and well tubing.

Other objects, features and advantages of the invention will be apparent from the drawings, the specification, and the claims.

In the drawings wherein like numerals indicate like parts and wherein several embodiments of this invention are shown:

FIG. 1 is a schematic view, partly in section and partly in elevation, illustrating a form of this invention in which the tubing and casing are utilized as electrical conduits;

FIG. 2 is a fragmentary section similar to FIG. 1 showing power being delivered to an electric motor;

Figure 3:
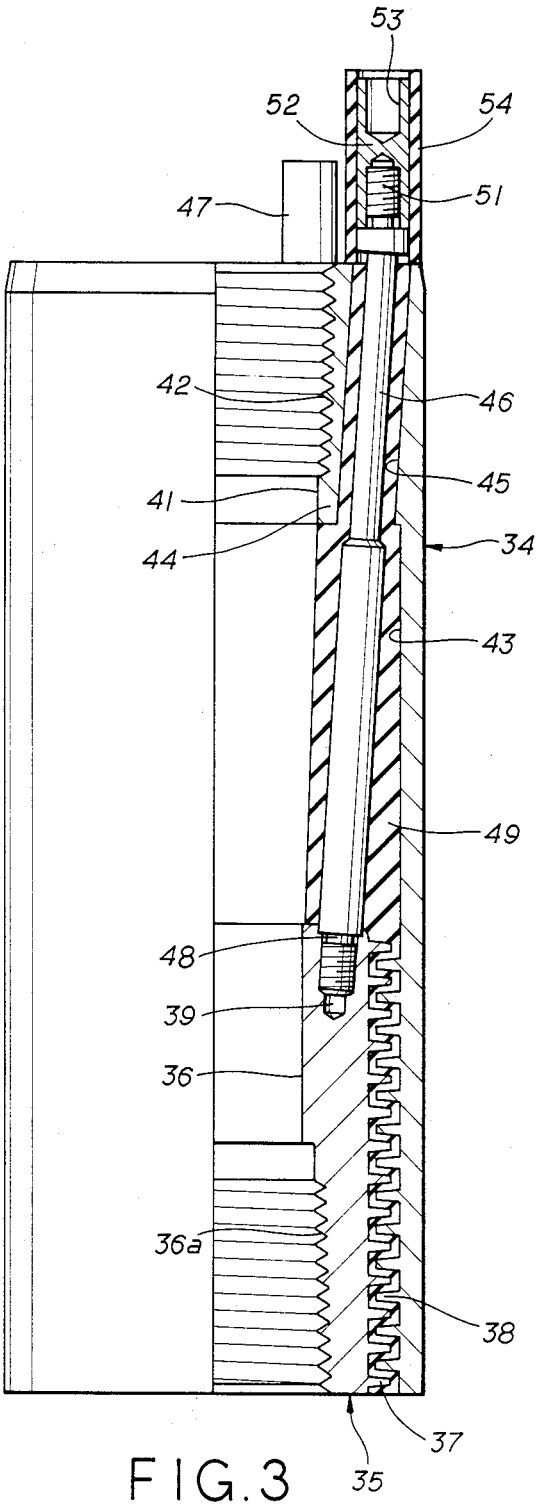
FIG. 3 is a view partly in elevation and partly in quarter-section of a tubing collar for use with the system of FIG. 1 or FIG. 2.

Referring first to FIG. 1, a petroleum well is shown to include a casing 10 in the well bore and secured to a wellhead indicated generally at 11. As is conventional, the casing and wellhead are formed of electrically conducting material such as steel. At the lower end of the casing perforations 12 admit fluid from the formation into the well bore.

A tubing having an upper section **13*a* and a lower section 13*b* is suspended in the casing and conveys well fluid to the surface and out through the pipe 14** to the gathering system of the field in which the well is located.

The upper and lower sections of the tubing are connected by an insulating collar 15 which electrically insulates the two tubing sections from each other while mechanically connecting the two sections. The lower tubing section is formed of electrically conducting material such as conventional steel. Preferably the upper section **13*a*** is also fabricated from steel.

Below the insulating collar 15 the tubing **13*b* is electrically insulated from the casing by a plurality of insulating spacers 16** which are carried on the exterior of the tubing and space the tubing from the casing. These spacers are of insulating material such as plastic and are spaced at intervals along the tubing as needed, such as on each joint of tubing, to electrically insulate the tubing from the casing.

At a selected depth which would be below the normal level of solids formation in the tubing, an electrical connection is made between the casing and the tubing. This electrical connection might take any form, such as the scratcher 17 which is of generally conventional form and includes contactors 18 which are designed to cut through any material which may be present on the casing and thus engage the casing to provide good electrical contact therewith. Of course, the scratcher and its contact are of electrically conducting material and are in electrical contact with the tubing **13*b* to electrically connect the tubing 13*b* with the casing 10**.

At the surface a source of power is provided for heating the tubing **13*b*. This source of power has one lead 19 which extends through the wall of the casing and is connected to the tubing 13*b* in any desired manner. In FIG. 1 this lead 19 is shown to connect to insulating collar 15. As will be explained hereinafter, the collar 15 is so designed that the lead 19 actually connects to a metal connector into which the tubing 13*b* is threaded to provide electrical connection between the lead 19 and the tubing 13*b***.

The other lead 21 from the power source is connected to the wellhead at any convenient point.

As the wellhead is thoroughly grounded to the surrounded earth, the wellhead is cold and personnel and equipment may be in contact with the wellhead without danger from contact with either the casing or the tubing section **13*a*** which connects to the wellhead and is thus also grounded.

Due to the coaxial relationship of the tubing and casing, and their relative diameters and thicknesses, the absorption of power is concentrated in the tubing and it has been found that approximately 90 percent of the power applied will be absorbed by the tubing.

While power may be applied to the tubing at any frequency between direct current and 1 megahertz, a reasonable frequency range is below about 100 kilohertz. Thus, for use of the invention to heat the tubing to prevent deposition of solids such as paraffin, it is preferred to use low frequency power such as the 50 or 60 cycle power normally available in oil fields. It has been found that use of 60 cycle power with the system shown in FIG. 1 results in substantial heating of the tubing.

Tests were run with a system such as shown in FIG. 1. The casing was shorted to the tubing at 2050 feet. Power was applied to the tubing and the casing at the surface. Power utilized was 60 cycle, 120 volt source commonly available in the United States. The following table shows the results as measured by indicators at selected depths in the well with the left figure showing the temperature Fahrenheit prior to heating, and the right figure showing the temperature Fahrenheit after the elapsed time. Thus, at 200 feet, application of 5000 watts for 10.8 hours resulted in an increase from 73 degrees to 85 degrees Fahrenheit.

| | INITIAL AND FINAL TEMPERATURE, °F. | | | | | | |
|---|---|---|---|---|---|---|---|
| | Elapsed time | Depth in Feet | | | | | |
| Power | in Hours | 200 ft. | 500 ft. | 800 ft. | 1200 ft. | 1600 ft. | 2000 ft. |
| 5000 watts | 10.8 | 73/85 | 76/85 | 82/91 | 91/101 | 97/106 | 102/111 |
| 6250 watts for the first hour; 5000 thereafter | 8.8 | 73/85 | 75/85 | 81/91 | 90/100 | 96/105 | 100/111 |
| Direct connection of well to 120 volt line 13,600 watts | 2.4 | 75/89 | 78/91 | 83/96 | 92/106 | 98/112 | 104/118 |

During this test, silicon controlled rectifiers (S.C.R.) were utilized to control the power applied.

Any desired voltage may be utilized. As the potential from tubing to casing is zero at the short all power applied will be converted to heat in the casing and tubing. Ample power will be available from relatively low voltage sources commonly available such as 120, 240, or 480 volts.

Power may be controlled in any desired manner such as by a model 18D-1-150 standard S.C.R., obtainable from Payne Engineering, Scott Depot, W. Va. As potential drops to zero at the short and heating is constant throughout the length of the tubing down to the short, the power used will be applied over the entire length of the tubing down to the short, with the short at any selected depth. As current is proportional to the voltage applied, it is preferred to use the line voltage available and control power by controlling average current. It is apparent, however, that voltage may be stepped up or down if desired.

If a different frequency from that available is desired, conventional frequency changing equipment may be included in the power source.

Referring again to FIG. 1, the lines 19 and 21 are connected to a junction box 22 which in turn connects to a S.C.R. 23. It will be understood that any type of power control could be utilized to regulate the amount of power applied to the well. The S.C.R. 23 receives power from the breaker box 24 which is connected to a field supply through lines 25 and 26.

FIG. 2 illustrates how this invention may be utilized to provide power to a load down in the well without the use of the conventional cables. For instance, power may be applied to a downhole pump through the tubing and casing, eliminating the need for running separate power lines downwell to the motor. The electric motor 27 is insulated from the tubing 13*b* by insulating collars 28 and 29 arranged above and below the motor. Electric leads 31 and 32 extend from the tubing 13*b* above and below the insulating collars 28 and 29 to the conventional connectors in the electric motor 27. The scratcher 17 provides electrical connection between the casing and the tubing 13*b* below the insulating collar 29. In this manner current is passed through the electric motor to provide power for the motor.

Power losses in the tubing and casing are acceptable. For instance, with a 26 KW resistive load at 2,013 feet, a total resistance of 0.49 ohms, a power source of 400 volts and a current of 65 amps, the potential drop would be 31.85 volts, and the power loss 270.25 watts.

Figure 4:
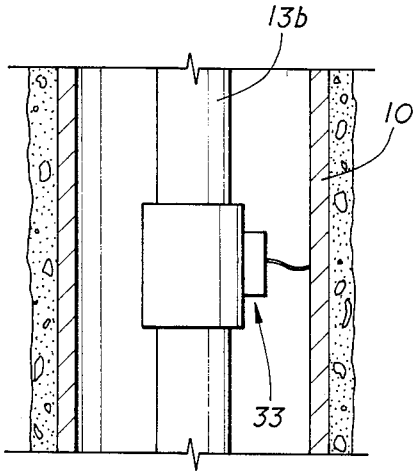
FIG. 4 is a fragmentary section similar to FIG. 1 illustrating the use of control devices at various levels in the well.

In some instances it may be desirable to control the amount of power that is absorbed at various levels down the tubing. For this purpose, one or more devices may be provided along the length of the tubing such as shown in FIG. 4 to draw off a portion of the power at levels above the scratcher 17. For instance, the S.C.R. power controller indicated generally at 33 may be provided to establish current flow between the tubing 13*b* and the casing 10 during a portion of a cycle of current, thus directing all of the current through the S.C.R. power controller during a portion of a cycle while the current continues down the tubing 13 during the remainder of a cycle.

In FIG. 3 there is shown a preferred form of insulating collar. The collar includes an upper connector indicated generally at 34 and a lower connector indicated generally at 35. The lower connector has a bore or flowway 36 therethrough which is provided with threads 36*a* at its lower end for making up with the tubing 13*b* below the collar. The lower connector is tubular in form and provided on its outer periphery a plurality of shelves 37 for interlocking with like shelves 38 on the lower end of the upper tubular connector 34. These shelves 37 and 38 may take any desired form. In the illustrated embodiment, the shelves 37 and the shelves 38 are provided by continuous helical projections in the nature of interlocking threads which are spaced from each other as shown in the drawing with the spaces filled with epoxy. The epoxy material provides electrical insulation between the upper and lower connectors. The interlocking shelves plus the epoxy provide mechanical support to suspend the tubing 13*b* from the collar.

At its upper end the lower connector 35 is provided with a threaded bore 39 for receiving an electrical conduit 46.

The upper connector 34 has a tubular formed body with a longitudinal bore 41 extending therethrough and forming with the bore 36 in the lower connector a flowway through the collar. The bore 41 is provided at its upper end with threads 42 for securing the collar to the tubing 13*a* thereabove.

The upper connector 34 is counterbored or enlarged at 43 from the runout of the helical shelf 38 to the thick wall section 44 of the upper shelf to receive insulating epoxy.

The thickwall section 44 of the upper connector has a longitudinal bore 45 extending therethrough for receiving the electrical connector 46. One or more peg-type protectors 47 are preferably provided on the upper end of the upper connector to protect the electrical connector 46 during assembly of the system.

The electrical connector 46 is a metal rod having a lower threaded end 48 for threaded makeup with the threaded bore 39 in the lower connector to provide an electrical connection. Within the area of the upper connector between the enlarged section 44 and the runout of the shelf 38, the electrical connector 46 has an enlarged diameter section to reduce its resistance in this area so that under high power conditions the epoxy filler 49 will not be overheated. The electrical conductor extends through the bore 45 and preferably terminates at its upper end in a threaded end 51 to which a fitting 52 may be threadedly attached. The fitting 52 has an upper internal blind bore 53 to which the insulated conduit 19 is connected as by silver soldering. After the fitting 52 has been connected to the conduit 46, a boot of rubber material 54 is applied about the fitting to insulate it. The boot may be carried by the conduit 19 and after the conduit 19 has been silver soldered to the fitting 52 and the fitting made up with the conductor 46, the boot may be pulled down over the fitting the provide the desired insulation.

In assembling the collar, suitable fixtures are provided for supporting the upper connector 34 and the lower connector 35 in the position shown in the drawing with the short conductor 46 in place and in threaded engagement with the threads in bore 39 of the lower connector. The fixture will bridge the enlarged bore 43 in the upper connector. Epoxy is injected into the space between the interlocking shelves 37 and 38 and flows upwardly through the fitting to fill the space between the shelves and to fill the enlarged area 43 as well as the annulus between the bore 45 and the conductor 46. Excess epoxy may be extruded at the top of the collar as by a plurality of vertical holes through the enlarged section 44 (not shown).

The internal sleeve of epoxy between the enlarged section 44 and the upper end of the lower connector 35 provides a substantial vertical length between the metal surface at 41 and the upper end of the lower connector. As the two connectors and electrical connector are formed of conducting metal, such as steel and copper, this tubular sleeve of epoxy prevents shorting between the upper and lower connectors and electric connector by the fluid in the coupling. Thus, if a mixture of oil and water passes through the coupling, the sleeve of epoxy prevents shorting by the water in the mixture.

If a well contains slugs of salt water the distance between the inner end of the lower connector and the enlarged wall section 44 of the upper connector should be spaced a sufficient distance that the resistance of a slug of salt water is many times greater than the resistance of the entire casing and tubing circuit. Thus with a casing and tubing circuit having a resistance of six-tenths of an ohm, this distance is preferably at least about two and one-half inches, as a column of salt water of this length has a resistance of six ohms and most of the current will flow in the tubing and casing circuit.

Any desired insulating material having acceptable properties may be used in the coupling. Preferably Stycast 1264 epoxy available from Emerson and Cuming, Inc. of Canton, Mass., is utilized.

Figures 5, 5A:
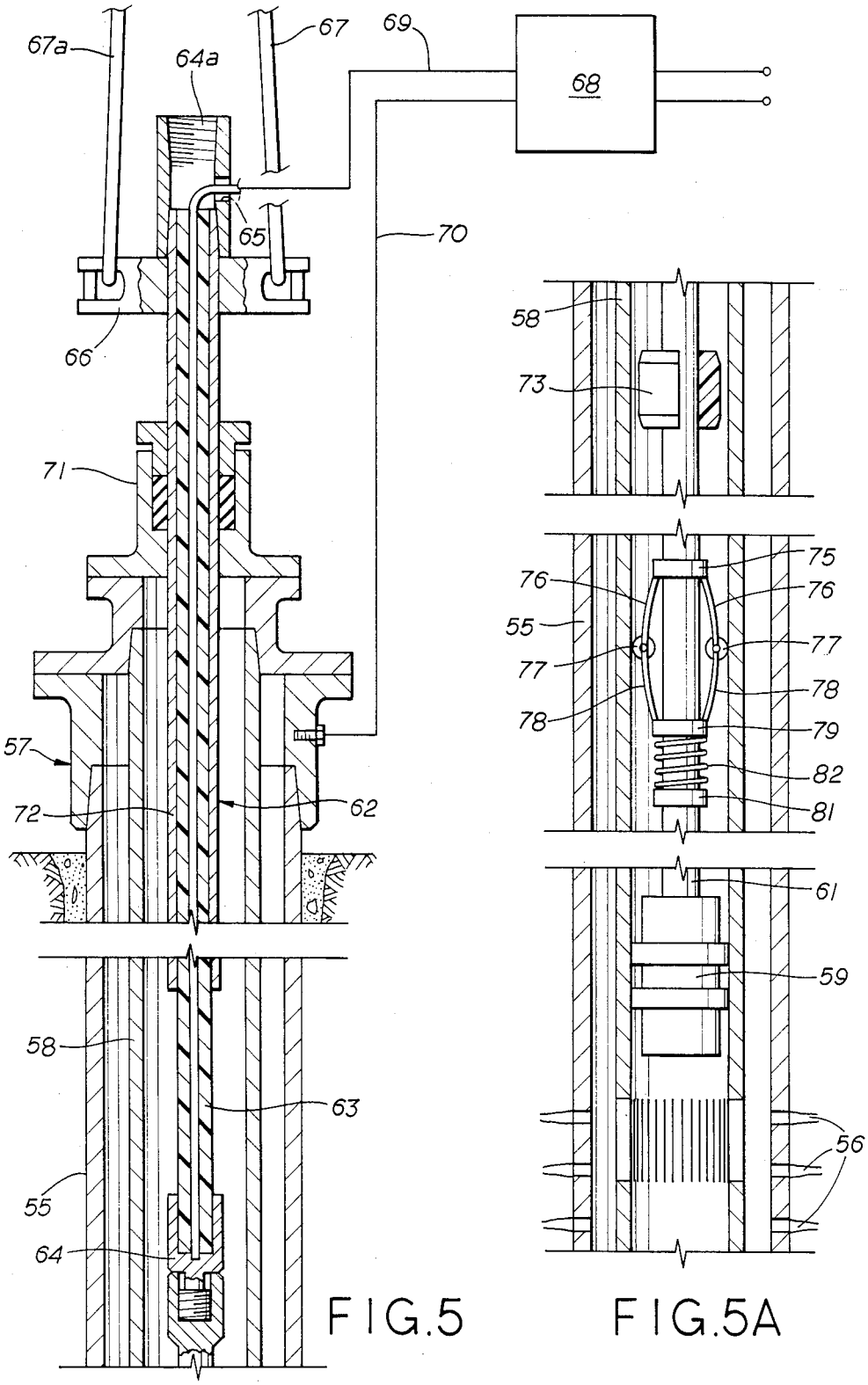
FIGS. 5 and 5A are continuation schematic views, partly in elevation and partly in section, illustrating use of a tubing and a sucker rod providing power to heat the tubing.

FIGS. 5 and 5*a* illustrate use of this invention in a pumping well with the sucker rod acting as a conduit. In this form of the invention, insulation between the tubing and casing is not required. In tests it has been found that shorting of the tubing to the casing makes substantially no difference in operation of the system. This is believed to be due to the skin effect of current flowing through the tubing. It is believed that the maximum current flows primarily along the inner wall and decreases radially outward from the inner wall of the tubing with very little current flowing along the outer wall of the tubing. For this reason, shorting between the tubing and casing does not significantly affect the heating of the tubing by the current flowing therethrough and of course heat transfer through the liquid medium from the sucker rod.

In this system the well includes the casing 55 extending down to the producing formation 56. The casing at its upper end is connected to the wellhead indicated generally at 57. Conventional tubing 58 is suspended from the wellhead 57. As is conventional, the tubing, casing and wellhead are all formed of steel.

Within the well there is provided a pump 59 at the lower end of a conventional sucker rod 61 also constructed of steel up to the polish rod.

The polish rod indicated generally at 62 is provided by a tubular fiberglas rod 63 having at its lower end a steel connector 64. Such steel end connectors are conventionally provided with fiberglas sucker rods and the steel connector 64 may be made up in the conventional manner with the upper end of the steel sucker rod 61.

At its upper end a special coupling 64*a* is secured to the fiberglas rod 63. This special coupling has a side port 65. A block 66 is positioned below the special coupling 64 and supports the entire sucker rod. A pair of cables 67 and 67*a* extend upwardly and are connected to the horsehead of a conventional walking beam.

To connect the source of power indicated generally at 68 to the steel sucker rod 61, an insulated conduit 69 extends through the port 65 and down through the hollow sucker rod 63 and is connected as by silver soldering to the steel fitting 64 below the lower end of the fiberglas polish rod 62. The source of power 68 is connected to the wellhead by conduit 70.

To provide a wear surface for the portion of the fiberglas rod 63 which passes through the stuffing box 71, the polish rod is provided with an external polished steel sleeve 72. This sleeve is carried by the fiberglas polish rod along the length thereof which reciprocates within the stuffing box 71.

Below the fiberglas polish rod 62 insulators 73 are secured to the polish rod at spaced points to insulate and space the sucker rod 61 from the tubing along the length of the sucker rod from the polish rod down to the selected area at which it is desired to establish electrical contact between the tubing and casing to define the lower limit of heating of the tubing. Any desired structure may be used to establish this short between the sucker rod and tubing. In the preferred form, a wheeled contact system is used. The system includes a collar 75 which is fixed to the sucker rod. Carrier rods 76 are hinged to the collar 75 and carry on their free ends the wheels 77. Expander rods 78 extend downwardly from the wheels 77 to a sleeve 79 which is slidably mounted on the sucker rod. A stop 81 is affixed to the sucker rod 61 and a spring 82 is held in compression between the stop 81 and the sliding sleeve 79 to exert an upward force on the sliding sleeve 78 and urge the wheels 77 into engagement with the wall of the tubing. Wheels 77 will run along the wall of the tubing and establish electrical contact therewith as the sucker rod is reciprocated. The fixed sleeve 75, the connecting rods 76 and the wheels 77 are made of electrically conducting metal to establish the electrical contact between the sucker rod and tubing.

It will be appreciated that a principal advantage of this form of the system lies in its application to an existing well without the need for pulling the tubing during installation as the sucker rod may be pulled and the equipment installed without disturbing the tubing.

Figure 6:
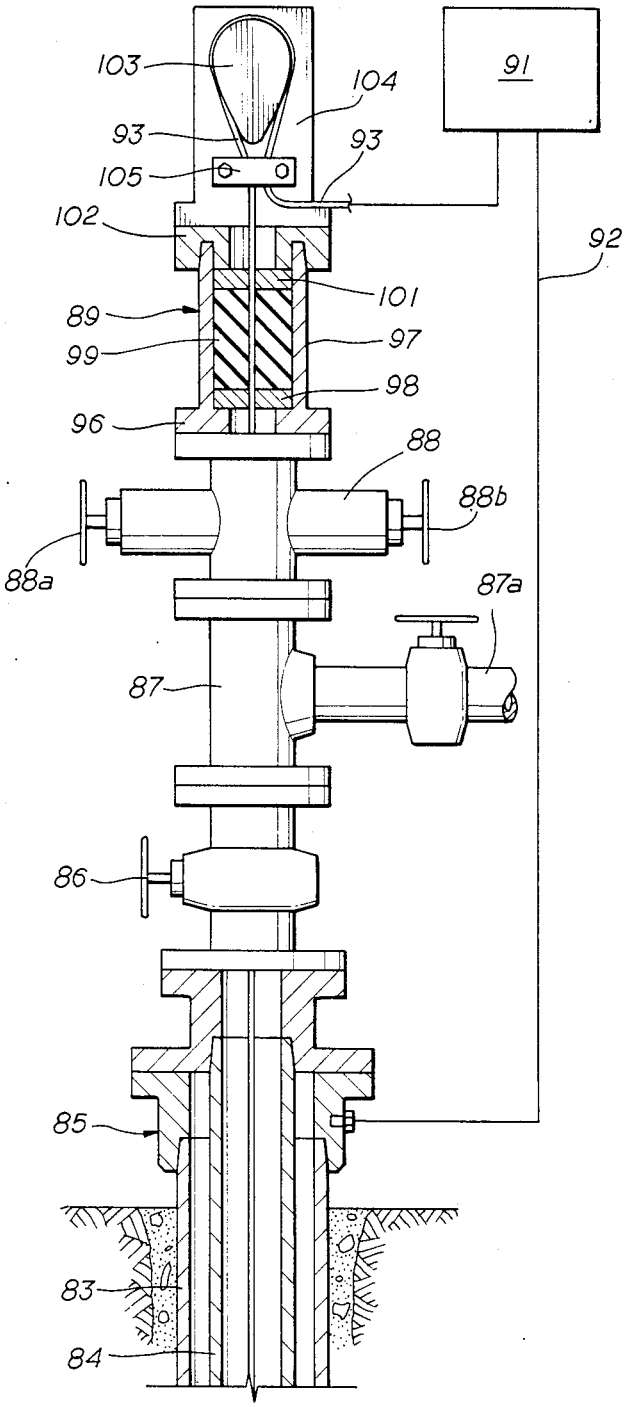
FIGS. 6 and 6A are continuation schematic views, partly in elevation and partly in section, showing an insulated conduit suspended in a well in which the conduit and the tubing are used as conductors to heat the tubing.

FIG. 6 illustrates another form of this invention for use in wells not employing a sucker rod without the necessity of pulling the tubing.

In the FIG. 6 form of the invention the well includes the conventional casing 83 having the tubing 84 suspended therein from a wellhead indicated generally at 85 which interconnect the tubing and casing. These structures are conventionally fabricated of steel.

The wellhead includes the conventional master valve 86 with a T-spool 87 thereabove providing a side connection 87*a* for conducting fluid to the surface equipment.

Above the T-spool 87 a valve 88 is provided for sealing about a cable when the valve 88 is closed. For instance, the valve 88 may be of the blowout preventer type having dual rams operated by the controls 88*a* and 88*b* with the rams designed to encircle and seal with an electric cable extending through the valve 88.

Sealingly flanged to the upper end of the valve 88 is a saddleblock support indicated generally at 89.

The power supply 91 is connected through lead 92 to the wellhead and a cable 93 extends from the power supply down through the saddleblock and valve 88 to the selected depth in the well where it is desired to commence heating. The lower end of the cable terminates in a bow-type scratcher 94 or other suitable means of making electrical contact with the tubing. A sinker bar 95 is suspended from the scratcher 94 to assist in running the electric cable into the well and maintaining it stretched out in the tubing. Of course, the cable 93 is insulated in the conventional manner of a core conductor with an outer sheath of insulating material to insulate the electrical conductor from the tubing above the scratcher 94. As in the previously explained systems, current flows through the insulated conductor 93 and through the tubing 84 to the wellhead connection 92.

Referring in detail to the saddleblock indicated generally at 89, the block includes a lower flange 96 adapted to be bolted to the valve 88 with a seal therebetween in conventional manner. Extending upwardly from the flange 96 is a tubular sleeve 97. The sleeve is threaded at its upper end. After the insulated conductor 93 has been run through the saddleblock, the steel plate halves, that is, two generally C-shaped members 98, are dropped into the tube 97 and rest on the flange 96. Then two C-shaped halves 99 of compressible material such as rubber are inserted into the tube 97 about the insulated conductor and rest upon the halves 98. Similar steel halves 101 are then inserted above the resilient halves 99 and a gland nut 102 is threadedly made up with the tube 97 to compress the packoff gland rubbers 99 about the insulated conductor 93 to provide a secondary backup seal.

Carried on the gland nut 102 is a heart-shaped support 103 supported on standard 104. The insulated conductor 93 extends upwardly from the well and over the support 103 and down to a clamp 105 which is secured to the two sections of the insulated conductor 93 immediately below the heart-shaped support 103. This or any other desired means may be utilized to support the weight of the insulated conductor in the well.

In a test utilizing the system of FIG. 6 the casing and tubing were in electrical contact and shorted at 575 feet and 2,050 feet. The wire extended down in the well to a depth of 800 feet where the wire was shorted to the tubing by a scratcher. Fifty feet of free wire was connected to a source of power delivering 2140 watts from a 120 volt source. Power was controlled by an S.C.R. power controller. After 12.5 hours temperature at 350 feet had increased from 77° F. to 89° F. and at 750 feet had increased from 80° F. to 90° F. This test demonstrated that shorting between the tubing and casing does not substantially reduce the efficiency of the system of FIG. 6.

From the above it will be seen that the invention illustrated in FIGS. 1 through 6 employs one or more of the vertical elements such as a casing-tubing, sucker rod, wire or the like extending down into the well as a conductor for heating and tubing. In some forms the casing provides a conduit and in other forms the tubing provides a conduit. In all forms either the casing or tubing provides a connection through the wellhead with the power supply which, because of the wellhead being grounded, may be termed a cold connection and there is no danger to personnel servicing the well.

The amount of heat generated by the wire may be controlled by using sections of wire of different diameters at different depths. This, of course, changes the resistance of the wire and the amount of heat which is generated by the wire.

Figure 7:
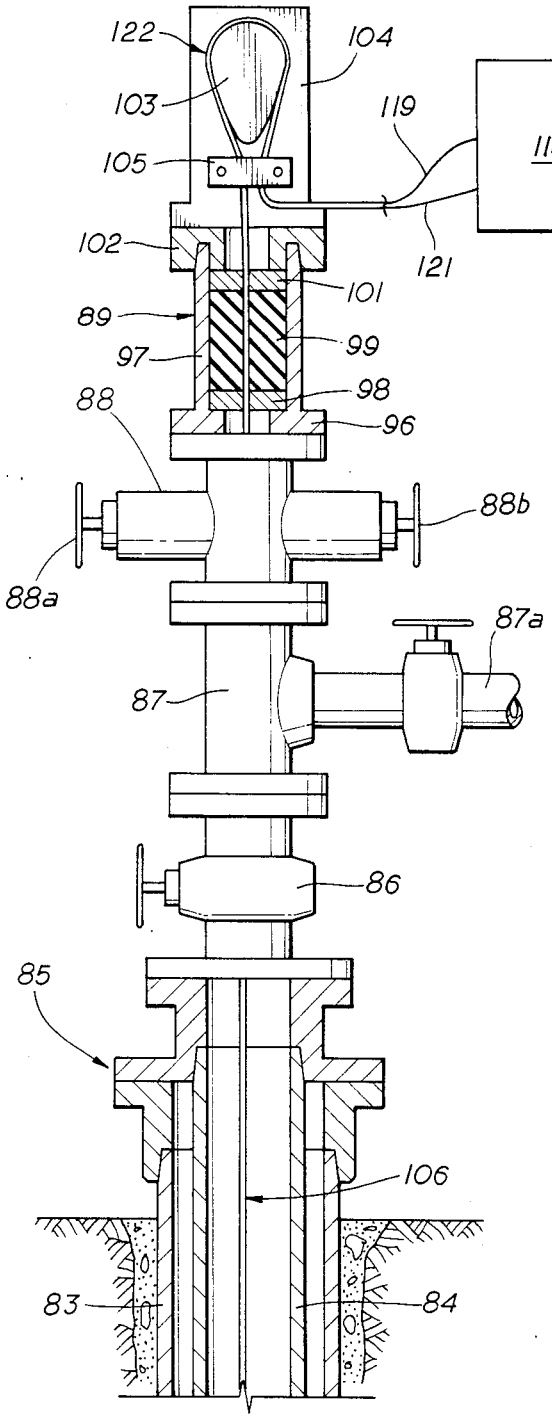
FIGS. 7 and 7A are continuation schematic views, partly in elevation and partly in section, showing a coaxial conduit suspended in a well in which the conduit is a loop having sections of different resistance along its length to provide uneven heating of a tubing and fluids therein.
Figure 7A:
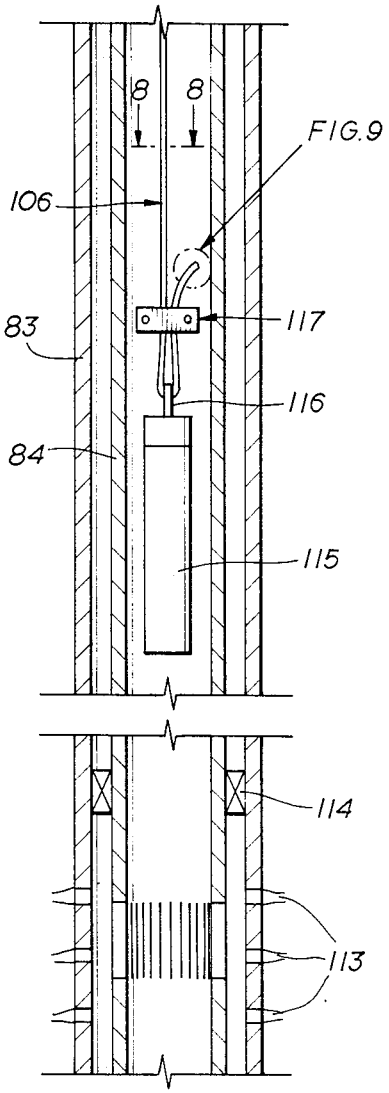
Figure 8:
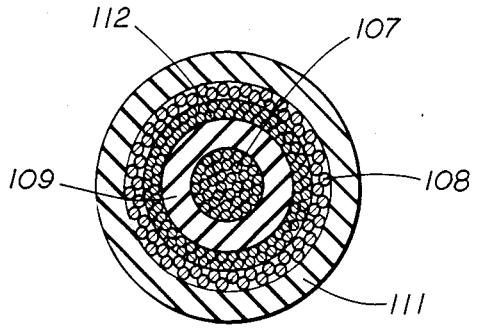
FIG. 8 is a view along the lines 8—8 of FIG. 7A.

In practicing the invention illustrated in FIGS. 7 and 7A, a loop of wire is first formed in a single cable. This loop of wire is provided by a coaxial cable indicated generally at 106 which has an inner conductor made up of several strands of wire 107 and an outer conductor made up of the wire braid 108. Between the inner and outer conductor a sheath of insulation 109 for electrically insulating the inner and outer conductor from each other is provided. The outer conductor is covered by a sheath of insulation 111.

In accordance with this invention the cable is designed to have different resistance along different sections of the wire. Normally, more heat is needed at the upper level of a well. Thus, it is preferred to form the lower section or sections of the cable such that their resistance is lower. This results in more heat being released in the upper sections of the well. This may be done by adding wires of lower resistance in the desired lower section or sections of the cable. Preferably, a braid of copper or copper alloy wire 112 is positioned in contact with an outer braid of steel wire.

The wire braid 108 is preferably of steel or steel alloy to provide adequate tensile strength to the cable.

Figure 9:
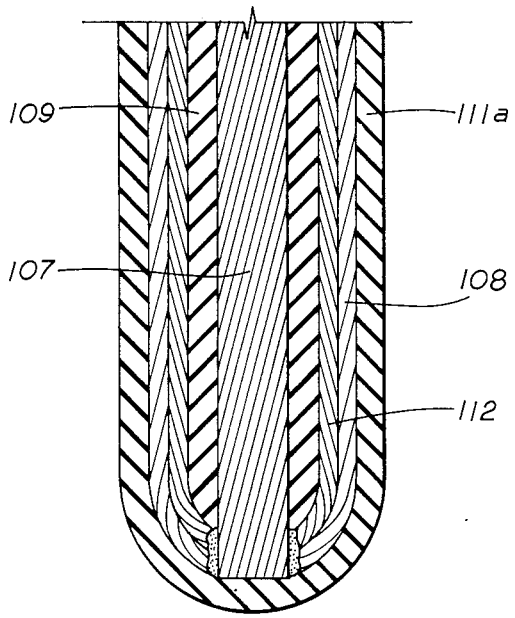
FIG. 9 is a view of the end of the conduit shown in the dashed circle of FIG. 7A.
Figure 10:
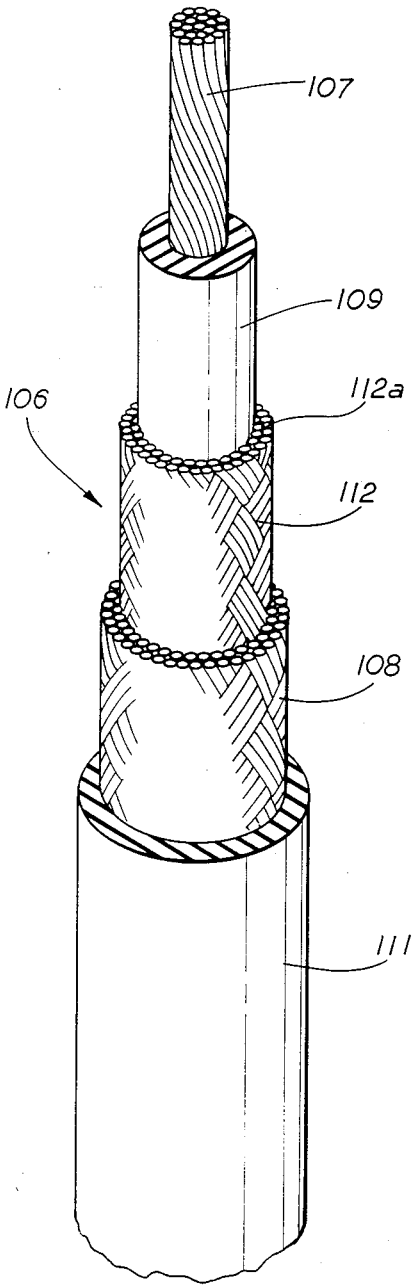
FIG. 10 is an elevational view of a fragment of the lower section of the cable shown in FIGS. 7A and 8, with progressively inward sections of the cable cut away to illustrate the construction of the cable.
Figure 13:
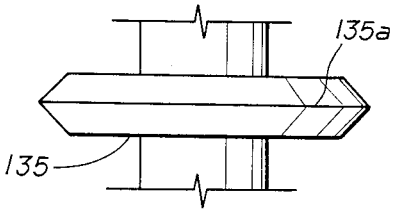
FIG. 13 is an enlarged fragmentary view of a section of the core of the electromagnet of FIG. 11.
Figure 14:
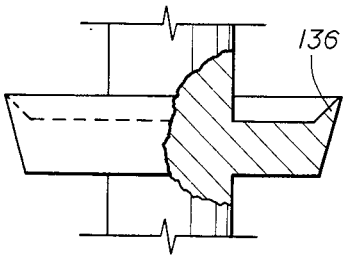
FIG. 14 is an enlarged fragmentary view of a section of the core of the electromagnet of FIG. 12.

As shown in FIG. 10, the low resistance wire 112 may terminate at its upper end **112*a*. The wire 112 extends downwardly to the end of the cable as shown in FIG. 9. As the steel braid extends the entire length of the cable and has higher resistance than the low resistance braid, greater heat will be generated above the upper end 112*a* of the copper braid. The coaxial cable of FIG. 10** is relatively inexpensive and may be fabricated in conventional manner by terminating the copper braid at the desired point on a cable and extending the steel wire braid for the full length of the cable.

The cable 106 is suspended in a conventional petroleum well having a casing 83 in which the tubing 84 is suspended. Production from the perforations 113 passes to the surface through the tubing 84. The well may have the conventional packer 114 between the tubing and casing.

The cable 106 may carry at its lower end means, such as a sinker bar 115 to assist in running the cable into the well and to maintain it in stretched out condition. The cable may be attached to the sinker bar in any desired manner, such as by providing the bail 116 on the upper end of the sinker bar and looping the free end of the cable 106 through the bail as shown and clamping the looped free end of the cable to the cable on the other side of the bail 116 by a clamp indicated generally at 117.

As shown in FIG. 9, the wires 108 of the outer conductor are electrically connected to the wires 107 of the inner conductor by any desired means, such as stripping back the inner insulation 109 and soldering the wires 108 to the wires 107. After the wires have been interconnected, the free end of the cable is covered with insulation material **111*a*, as shown in FIG. 9**.

The wellhead includes the conventional master valve 86 with a T-spool 87 thereabove providing a side connection **87*a*** for conducting fluid to the surface equipment.

Above the T-spool 87, a valve 88 is provided for sealing about the cable 106 when the valve 88 is closed. For instance, the valve 88 may be of the blowout preventer type having dual rams operated by the controls **88*a* and 88*b* with the rams designed to encircle and seal with the electric cable 106 extending through the valve 88**.

Sealingly flanged to the upper end of the valve 88 is a saddleblock support indicated generally at 89.

A power supply 118 is connected through the lead 119 to the inner conductor of the cable 106 and lead 121 to the outer conductor of the cable. The power supply 118 receives current from any available source such as conventional 120 volt, 240 volt or 480 volt power generally available at oil fields. The source 118 includes a means for controlling the power. This control means may include a transformer if it is desired to change the available voltage and a means for controlling the current. Preferably a silicon controlled rectifier (SCR) is utilized to control the power applied. While the power applied may be at any frequency between direct current and 1 megahertz, a reasonable power level is below about 100 kilohertz. Line frequency such as the 60 cycle frequency normally available in the United States and 50 cycle frequency available in many other countries is preferred.

A low voltage power supply is preferred. Preferably, the voltage is not greater than 480 volts as potentials of this level are commonly available in the oil fields. The conduits of the cable are selected to be a metal which provides a sufficiently high resistance to result in substantial heating of the cable. For instance, the wires 107 of the center conductor may be of copper. It is preferred that the wires 118 of the outer conductor be braided steel wires to provide the strength needed to support the long wire in the well down to depths of 2,000 feet or more and the weight of the sinker bar 115.

The cable 106 is suspended from the saddleblock 122 at a selected depth in the well. This depth would be selected to be below the depth in the well at which solids such as paraffin normally deposit out on the tubing. The free end of the cable could extend to any point below this area of the tubing but it is preferred to extend the cable only to the area immediately below the normal deposition area so that heat will be concentrated from this point up to the surface.

Referring in detail to the saddleblock shown at 122, the block includes a lower flange 96 adapted to be bolted to the valve 88 with a seal therebetween in the conventional manner. Extending upwardly from the flange 96 is a tubular sleeve 97 which is sealingly secured to the flange 96. The sleeve is threaded at its upper end by threads which are not shown. After the insulated conductor 106 has been run through the saddleblock, the steel plate halves, that is, two generally C-shaped members 98, are dropped into the tube 97 and rest on the flange 96. Then the two C-shaped halves 99 of compressible material such as rubber are inserted into the tube 97 about the cable 106 and rest upon the halves 98. Similar steel halves 101 are the inserted above the resilient halves 99 and a gland unit 102 is threadedly made up with the tube 97 to compress the packoff gland rubbers 99 about the cable 106 to provide a secondary backup seal.

Carried on the gland nut 102 is a heart-shaped support 103 supported on a standard 104. The cable 106 extends upwardly from the well and over the support 103 and down to a clamp 105 which is secured to the two sections of the cable immediately below the heart-shaped support 103. This or any other desired means may be utilized to support the weight of the insulated conductor in the well.

For instance, another preferred form of support is a wire mesh cable grip available from Kellems division of Harvey Hubbell of Stonington, Conn. This cable grip may also be utilized to connect the cable to the sinker bar 115.

Figure 6A:
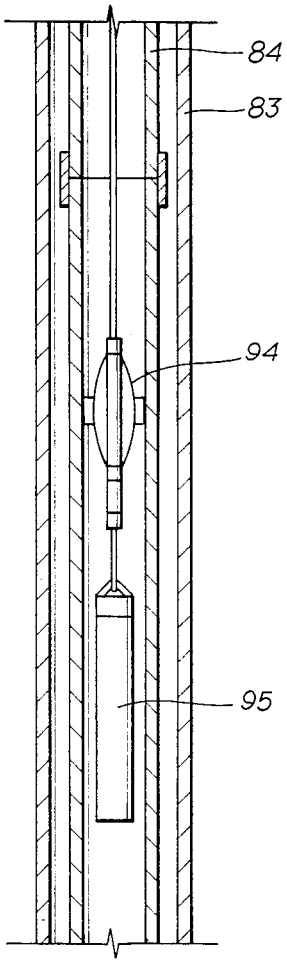
Figure 11:
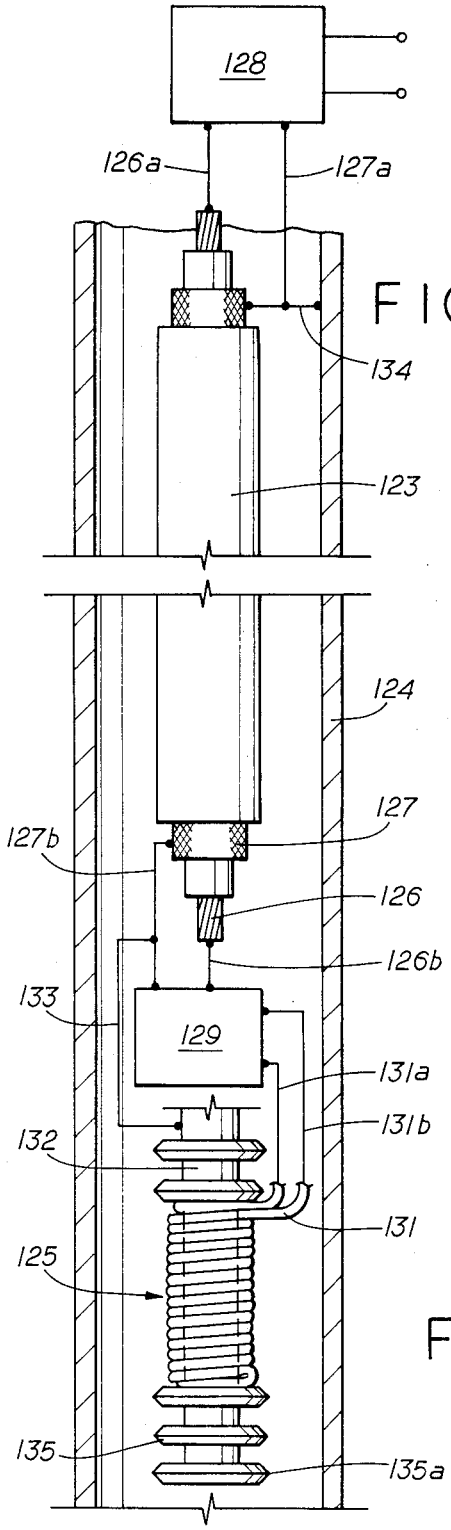
FIG. 11 is a view partly in cross-section and partly in elevation of a system in accordance with this invention in which the cable carries at its lower end an electromagnet which provides an electrical connection between the cable and the tubing.

FIG. 11 illustrates a form of this invention similar to the invention disclosed in FIGS. 6 and 6A in which the cable 123 is suspended in a tubing 124 and held in the extended position by an electromagnet 125, the core of which provides the contact with the tubing. Thus, the electromagnet 125 provides the function of the scratcher 94 and the sinker bar 95 of the form of invention illustrated in FIG. 6A.

The cable 123 has an inner conductor 126 of relatively low resistance, such as provided by a No. 8 copper wire formed of 37 strands of No. 24 tinned copper wire. The outer conductor 127 is provided by a steel braid of relatively high resistance, such as 96 strands of 0.012 inch diameter 1006 galvanized steel. A source of power 128, such as the power sources and controls discussed hereinabove, is connected to the inner conductor 126 through line **126*a* and to the outer conductor 127 through line 127*a***.

The electromagnet 125 may be powered by the AC current supplied from source 128, but it is preferred that the power be converted to a direct current to provide a much more powerful magnet. For this purpose, means such as the bridge rectifier 129 is connected in the circuit. Thus, the inner conductor 126 is connected through line **126*b* to the bridge rectifier and the outer steel braid 127 is connected to the bridge rectifier through line 127*b*. The continuous coil of wire 131 of the electromagnet has its ends 131*a* and 131*b* connected to the bridge rectifier 129**.

The electromagnet includes an iron core 132 which is connected to the outer conductor 127 by lead 133. When the core is in contact with the tubing the circuit through the iron core is completed by the lead 134 connecting the outer conductor 127 to the tubing. Preferably, this connection 134 is made with the wellhead, as shown in FIG. 6.

In operation, the cable is run into the well to the desired depth. Then, power is supplied from the source 128. This power first activates the electromagnet 125 which will cause it to shift laterally into engagement with the tubing 124. The iron core 132 of the magnet has a plurality of radially extending flanges 135, having V-shaped outer peripheries to provide sharp edges **135*a* for engaging and making electrical contact with the tubing. As conventional steel tubing found in petroleum wells will have a much lower resistance than the resistance of the steel braid 127, current will thereafter primarily flow through the tubing 124 in preference to flowing through the outer steel braid 127 and heat will be applied through the inner conductor 126 and the tubing 124** to prevent the formation of solids such as paraffins or hydrates.

Figure 12:
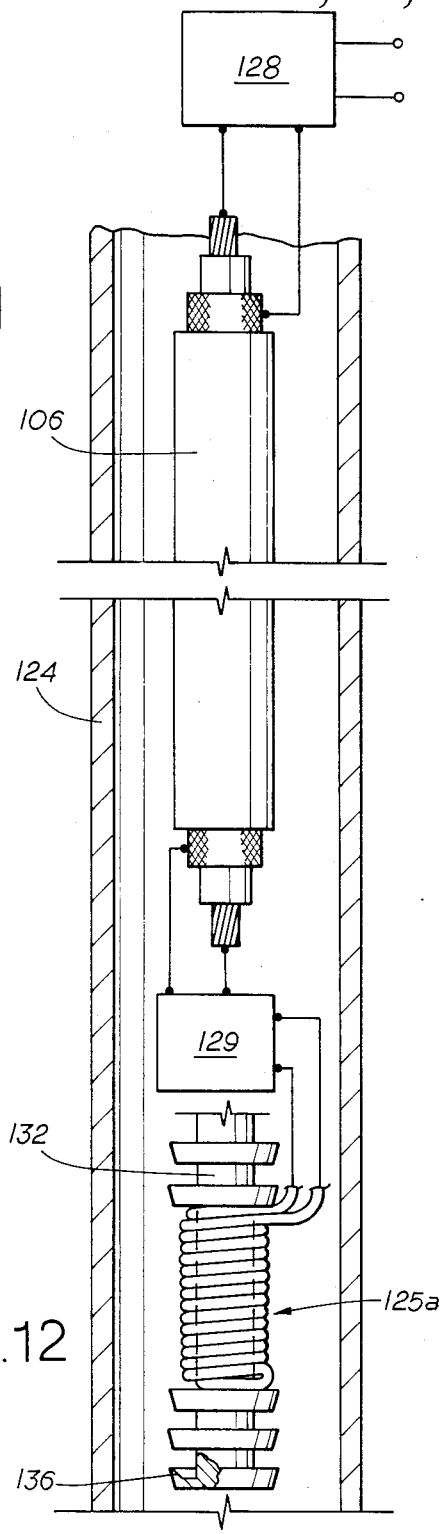
FIG. 12 is a view similar to FIG. 11 in which the electromagnet provides an anchor for the lower end of a cable suspended in a well.

FIG. 12 illustrates the use of the electromagnet **125*a* similar to magnet 125 to anchor the cable in the well and may be substituted for the sinker bar 115 of FIG. 7A. Also, the conduit may be conduit 106 of FIG. 10 and include the section of low resistance as previously explained. In this form of the invention, the connections 133 and 134 are omitted and no current flows through the tubing 124; the electromagnet 125*a* acts solely as an anchor. Otherwise, the system of FIG. 12 is substantially similar to FIG. 11**.

To facilitate the anchoring function, the flanges on the core 132 are modified, as shown at 136, to provide an upwardly facing sharp edge which will tend to dig into the tubing and anchor the cable 106 against any upward force exerted on the cable while the electromagnet is energized. Upon the deactivation of the electromagnet, the force urging the flanges 136 into engagement with the tubing is removed and the cable and electromagnet may be readily retrieved from the well.

The foregoing disclosure and description of the invention are illustrative and explanatory thereof and various changes in the method and in the size, shape and materials, as well as in the details of the illustrated construction, may be made within the scope of the amended claims without departing from the spirit of the invention.

What is claimed is:

1. A system of inhibiting formation of solids in a petroleum well comprising:

a grounded wellhead of electrically conducting material, a tubing of electrically conducting material attached to said wellhead, a sucker rod for a pump in said tubing, said sucker rod having a tubular rod section of non-conducting material insulating said rod from said wellhead, said sucker rod below said section formed of electrically conducting material, connecting means below said section electrically connecting said sucker rod and said tubing, vertically spaced insulators on said sucker rod insulating said sucker rod from said tubing between said section and said connecting means, and a source of current having a first connection to said wellhead and a second connection to said sucker rod below said section, said second connection between said source of current and said sucker rod including a conduit extending through said tubular rod section and connected to said sucker rod below said section.

2. The system of claim 1, wherein said connecting means is a follower on said sucker rod having wheels in electrical contact with said tubing.

3. A system for inhibiting formation of solids within a petroleum well comprising:

a grounded wellhead of electrically conducting material, a casing of electrically conducting material attached to said wellhead, a tubing attached to said wellhead and positioned within said casing, collar means in said tubing and below said wellhead electrically insulating the tubing above said collar means from the tubing below said collar means, said tubing below said collar means formed of electrically conducting material, connecting means below said collar means electrically connecting said tubing and casing, vertically spaced insulators on said tubing insulating said tubing from said casing between said collar means and said connecting means, and a source of current connected to said wellhead and to said tubing immediately below said collar means.

4. A power transmission system for wells comprising:

a grounded wellhead of electrically conducting material, a casing of electrically conducting material attached to said wellhead, a tubing attached to said wellhead and positioned within said casing, collar means in said tubing and below said wellhead electrically insulating the tubing above said collar means from the tubing below said collar means, said tubing above and below said collar means formed of electrically conducting materials, a load electrically connected to said tubing below said collar means, connecting means electrically connecting said load to said casing, vertically spaced insulators on said tubing insulating said tubing from said casing between said collar means and said load, and a source of current electrically connected to said wellhead and to said tubing below said collar means.

5. The system of claims 3 or 4 wherein:

said collar means includes upper and lower connectors of electrically conducting material concentrically arranged with a portion of one connector within the other connector and provided with threads for making up with the tubing above and below the collar, at least one interlocking shelf carried by the upper and lower connectors, insulating material between said upper and lower connectors, and said connection between said source of current and said tubing below said collar means includes an insulted conduit extending through said upper connector and connected to said lower connector.

6. A tubing collar comprising:

inner and outer tubular connectors of electrically conducting material concentrically arranged with one end of the inner connector positioned intermediate the ends of the outer connector and provided with threads for making up with the tubing above and below the collar, a plurality of circumferentially extending interlocking shelves carried by the inner and outer connectors, insulating material between the inner and outer connectors, said insulating material additionally extending from said one end of the inner connector along the inner surface through the outer connector and away from the inner connector a selected distance to minimize shorting between the tubular connectors by a mixture of conducting and non-conducting liquid flowing through the collar, and one of said connectors including means for connecting an electrical conduit to said one connector.

7. The collar of claim 6, wherein:

the means for connecting an electric conduit is in the inner tubular connector, the outer tubular connector has a longitudinally extending hole through at least a portion of its wall and terminating on the exterior of the connector, and a conduit extends through said hole and is connected to the inner connector.

8. The collar of claim 6, wherein said insulating material embeds said electrical conduit and fills said hole about said conduit.

9. A system for inhibiting formation of solids within a petroleum well having a production tubing comprising, a coaxial cable extending down the tubing, said cable provided by a central conductor and a coaxial braid of steel wire along its entire length and wires of less resistance than said braid of steel wire in engagement therewith at spaced points along its axial length to provide a path of low resistance along a section of said cable, means connecting said central conductor and braid of steel wire at the lower end of the cable, and means for maintaining said cable extended in said tubing.

10. The system of claim 9 wherein said means for connecting said central connector and braid of wire and for maintaining said cable extended in said tubing is an electromagnet connected to said central conductor and braid of wire.

11. A system for heating the tubing of a petroleum well comprising a wellhead, a tubing suspended from the wellhead, a stuffing box on the wellhead, a multi-conductor cable supported by a saddleblock on the wellhead and extending down through the stuffing box and through said tubing to a selected depth in the well, means interconnecting said multi-conductor of said cable at said selected depths, and control means for a source of electric current at the surface connected to said conductors, at least one of said conductors having different resistances at different depths to provide uneven heating at different depths in the well;

said cable including, a central conductor, inner insulation material around said central conductor, a braided steel conductor around said insulation material, outer insulation material around said braided steel conductor, and wire means having lower resistance than said braided steel conductor along the lower section of said cable and in electrical contact with said braided steel conductor to lower the total resistance of said lower cable section.

12. The system of claim 11 wherein the said lower resistance wire means is provided by a braid of copper wire.

* * * * *